US007146120B2

(12) United States Patent
Ogane et al.

(10) Patent No.: US 7,146,120 B2
(45) Date of Patent: Dec. 5, 2006

(54) IMAGE FORMING APPARATUS HAVING A CORONA DISCHARGE AIR SUPPLYING SECTION

(75) Inventors: Atsushi Ogane, Hachioji (JP); Takayuki Horie, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 35 days.

(21) Appl. No.: 10/991,916

(22) Filed: Nov. 18, 2004

(65) Prior Publication Data

US 2005/0238379 A1 Oct. 27, 2005

(30) Foreign Application Priority Data

Apr. 27, 2004 (JP) ..... 2004-130616

(51) Int. Cl.
*G03G 21/20* (2006.01)

(52) U.S. Cl. ..... 399/92

(58) Field of Classification Search ..... 399/91, 399/92, 93

See application file for complete search history.

(56) References Cited

U.S. PATENT DOCUMENTS 6,847,795 B1 * 1/2005 Hirose et al. ..... 399/92

* cited by examiner

*Primary Examiner*—Hoang Ngo
(74) *Attorney, Agent, or Firm*—Lucas & Mercanti, LLP

(57) ABSTRACT

An image forming apparatus having a corona discharger for charging a photoreceptor with an electrostatic charge, a fixing unit to fix a toner image onto a recording medium, a fan for drawing air to cool the fixing device and a space adjacent the fixing device and the duct communicating the fan, the duct having an opening to guide air into the corona discharger via another opening provided in the rear plate functioning as a shielding electrode of the corona discharger.

5 Claims, 7 Drawing Sheets

IMAGE FORMING APPARATUS HAVING A CORONA DISCHARGE AIR SUPPLYING SECTION

FIELD OF THE INVENTION

The present invention relates to an image forming apparatus such as a copier, facsimile machine, printer, etc. More particularly the present invention relates to an image forming apparatus employing an electro-photographic system having a corona discharger for an electrostatic discharger whose function is improved by substantially removing ozone generated by the static discharger.

BACKGROUND OF THE INVENTION

In an image forming apparatus employing an electro-photographic system, a static discharger employing a corona discharger such as a scorotron discharger is utilized in many cases. The static discharger employing a corona discharging system comprises discharger wires extending along the surface of a photo sensitive material, a shielding plate (rear plate) formed of a metal sheet so as to surround the discharger wires, and a mesh formed grid electrode (control electrode) provided between the discharging wires and the surface of the photo-sensitive material.

This static charger causes the discharging wires corona discharge by applying a high voltage (6K–8K volts) to the discharging wires and charges the photosensitive material with positive or negative electrons. Also the static charger is configured so as to adjust the static voltage of the photosensitive material by applying a bias voltage to the grid electrode.

It is known that in a corona discharge, much ozone is generated when electric charges are generated and has an adverse influence on image forming by remaining in the static discharger. For example, in an image forming apparatus employing an electro-photographic system, a rear plate is provided adjacent to the discharging wires in order to efficiently charge the photosensitive material. Consequently, it is know that generated ozone, etc. remains around the discharging wires in the static discharger which oxidizes the surface of the discharging wires and causes unevenness of electric charges during subsequent image forming operation.

In order to solve the above problems, several technologies are employed. Paragraph 0007 of Japanese Patent Open to Public (H07-334047) discloses a technology for efficiently removing ozone from a static discharger. Paragraph 0010 of Japanese Patent Laid Open to Public (H10-198238) and paragraph 0006 of Japanese Patent Open to Public (2000-365987) disclose a technology for blowing air into a static discharger so as not to adhere polluted air containing a suspended matter such as toner, etc. onto discharging wires. For example, Japanese Patent Open to Public (H07-334047) discloses an image forming apparatus featuring a duct with a dedicated air fan to exhaust air current into a corona discharger and an ozone disposal mechanism for guiding air current containing ozone to an ozone filter.

Japanese Patent Open to Public (H10-198238) discloses a technology to provide a static discharger by which discharge wires are uniformly oxidized by equalizing an air current blown in a shielding case along the longitudinal direction of the shielding case by providing a dedicated air duct and an air fan which exhaust most of the ozone being adhered onto the discharge wires. And Japanese Patent Open to Public (2000-365987) discloses an apparatus for removing ozone in an electrostatic charger by exhausting air within the electrostatic charger by providing an air-intake opening and an air-exhaust opening in an electrostatic charger employing a corona discharging system.

The structure of the image forming apparatus having a duct with a dedicated air fan for exhausting ozone by drawing air into an electrostatic charger is easily configured. However, it is a challenge to design a compact image forming apparatus and can be a main cost-up factor of the image forming apparatus. The importance of a blowing-air system is lowered in regard to a solution for the problem of a suspended matter such as toner and ozone remaining in an electrostatic charger adhered on discharge wires which cause unevenness of electrification since a method to prevent unevenness of electrification by sliding a cleaning mechanism (a wire cleaner) along the discharge wires has become a common practice.

The main purpose for blowing air into an electrostatic charger is not to removing ozone, etc. remaining in the electrostatic charger but to reduce image defects, such as image unevenness caused by ozone remaining in the electrostatic charger and to remove the factor preventing electrified charges from uniformly working on the surface of a paused photosensitive material. The effective means for blowing air to an electrostatic charger is not to continuously blow air to the electrostatic charger, but it is to blow enough air over a predetermined time after a copying operation. Continuously blowing air is not the optimal solution and the operation should be limited since continuously blowing air tends to foul the inside of the apparatus.

SUMMARY OF THE PRESENT INVENTION

The present invention is proposed to solve the above problem. An object of the present invention is to provide an image forming apparatus which prevents image unevenness caused by ozone remaining in the electrostatic charger by agitating ozone by air flowing into the electrostatic charger. Another aspect of the object of the present invention in terms of an agitating device for agitating ozone is to provide an image forming apparatus having no dedicated air fan and duct system by effectively utilizing the air current used for a cooling device to suppress the temperature rise caused by a fixing roller and the fusion of toner in a cleaning apparatus.

In order to attain an above object, the image forming apparatus of the present invention comprises a photosensitive material, an electrostatic charger for charging the surface of the photosensitive material via a corona discharge, an exposure device for forming an electrostatic latent image on the electrified photosensitive material by irradiating light transferring image information, a developing device for forming a toner image by developing the electrostatic toner image formed on the photosensitive material, a transferring device for transferring the toner image formed on the photosensitive material onto a recording medium, such as a paper sheet, a fixing device for fixing the toner image transferred onto the recording medium, such as a paper sheet and a cooling device incorporating a fan and a duct to provide air for cooling the fixing device and the area adjacent to the fixing device. The wall of the fan duct being adjacent to the electrostatic charger is provided with an opening to guide the air current to the electrostatic charger.

The electrostatic charger comprises discharging wires extending along the surface of the photosensitive material, a grid electrode between the photosensitive material and the discharging wire and the rear plate having an opening so as to surround the discharging wires. The opening provided on the duct wall is arranged so as to guide the air current to the interior of the electrostatic charger.

In the image forming apparatus of the present invention, a controller for controlling the air current is provided so that the air flowing operation to the electrostatic charger is conducted over a predetermined time period after the completion of a copying operation. In a preferred embodiment of the present invention, a shutter member is provided for the opening in the duct wall to not only control the operation time for air flow but also to control closing and opening of the air flow channel to the electrostatic charger by the shutter member.

DETAIED DESCRIPTION OF THE INVENTION

Figure 1:
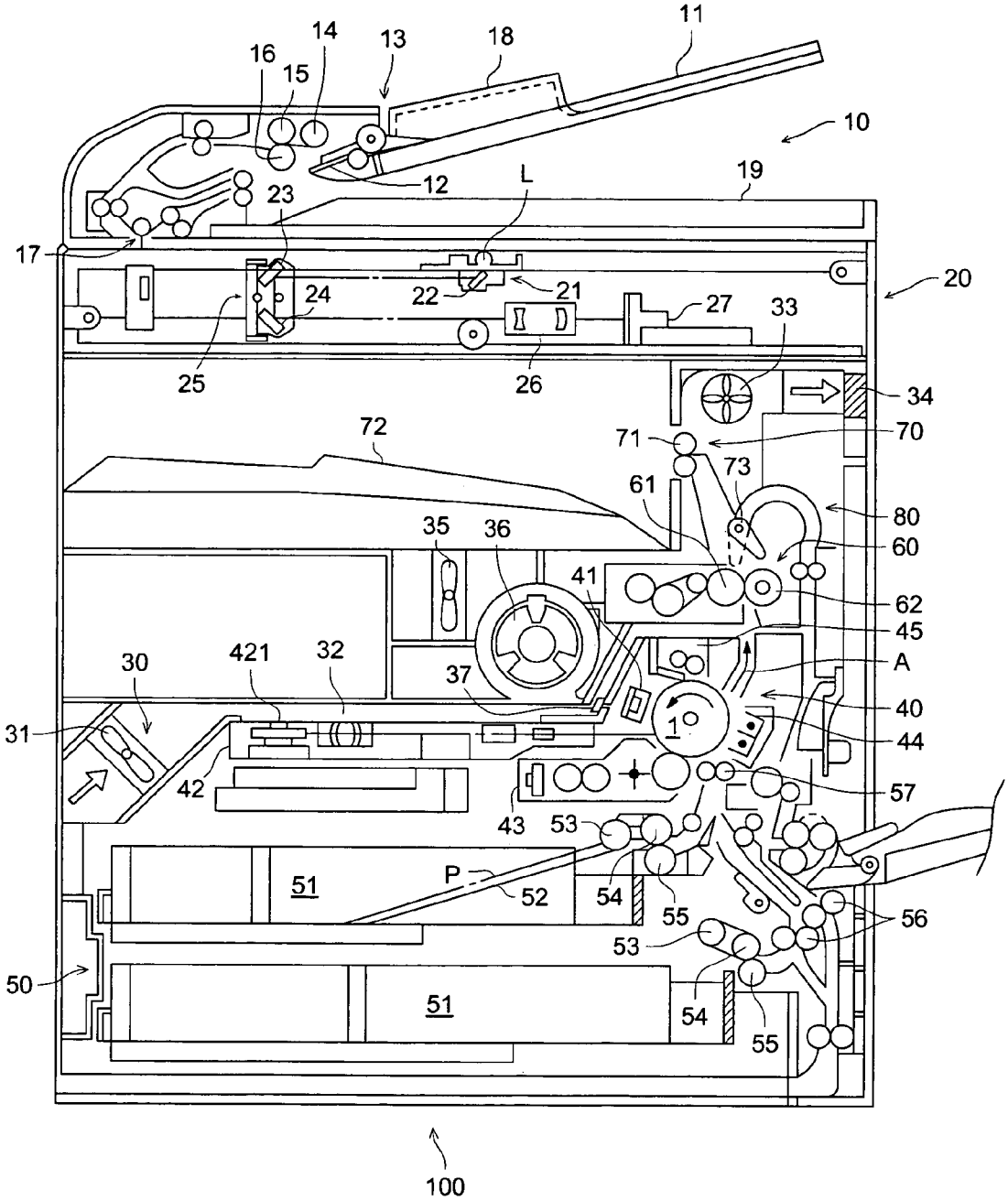
FIG. 1 is an overall block diagram showing the image forming apparatus of the present invention.

The embodiment of the present invention will be described below by using attached drawings. FIG. 1 is a block diagram of image forming apparatus 100 of the present invention. Image forming apparatus 100 of the present invention is not limited to the embodiment as described below and any minor variations and modification are included within the scope of the invention. In FIGS. 1–6, the same number indicates the same part or area.

Image forming apparatus 100 comprises automatic document feeder 10, image reader 20, an image processing section (not shown), image forming section 40, paper sheet feeder 50, fixing section 60, paper sheet ejector 70 and re-transporting path 80 for automatic duplex copying. Image reader 20 and automatic document feeder 10 are arranged on the main body of image forming apparatus 100.

Automatic document feeder 10 comprises document platform 11, ejecting platform 19 and document feeding mechanism 13 incorporating document pressing plate 12, rollers 14, 15 and 16 and a document path. Paired rollers 14, 15 and 16 in document feeding mechanism 13 comprise three types of rollers such as pickup roller 14 for drawing out a document from document feeder 11, feed roller 15 for feeding the document into the document path and separating roller 16 to prevent document stack to each other.

Document platform 11 incorporates a document plate on which plural documents can be set and a pair of positioning boards for precisely locating a document in the lateral direction provided for subsequent movement in the lateral direction. Documents are placed on document platform 11 with the image surface face-up where individual sheets are forced upward by pickup roller 15 and fed from document platform 11 by pickup roller 15, and if stacked together, separated by separating roller 16 and individually transported into the document transporting path.

Slit glass 17 is provided between the top end of the document path and image reader 20 while ejecting platform 19 is provided under document platform 11. A document fed into the document path by document feeding mechanism 13 is read by image reader 20 while passing over slit glass 17, then ejected by other transportation rollers and placed on ejecting platform 19.

Image reader 20 comprises scanning unit 21 incorporating light source L for irradiating the document and mirror 22, moving unit containing two pieces of half mirrors 23 and 24 for guiding a reflected light, image forming lens 26 and CCD image sensor 27 (CCD sensor).

In image reader 20, light source L in scanning unit 21 pausing under slit glass 17 reads image data by irradiating the document when the document passes over the slit glass 17 provided in the transporting path. Reflected lights passing via movement unit containing two pieces of half-mirrors 23 and 24, whereby image forming lens 26 forms an image on CCD sensor 27.

CCD sensor 27 convert scanned optical image data into electric image data and send it to an image processing section provided on a system printed circuit board. The image processing unit send the image information data to image forming section 40 after conducting analog processing, A/D (Analog to Digital) conversion, shading correction and image data compression, etc.

Image forming section 40 contains photoreceptor 1 on which a latent image is formed. Along the surface of photoreceptor 1, provided are electrostatic charging apparatus 41 to charge the surface of photoreceptor 1 via corona discharge, exposing apparatus 42 to form an electrostatic latent image on the photoreceptor 1 having been charged based on image information by the irradiating lights, developing apparatus 43 to transfer the toner image formed on photoreceptor 1, transferring apparatus for transferring the toner images formed on photoreceptor 1 to the recording medium, such as a paper sheet P and cleaning apparatus 45 for cleaning the surface of photoreceptor 1 of any residual toner after completion of the transferring operation.

Figure 2:
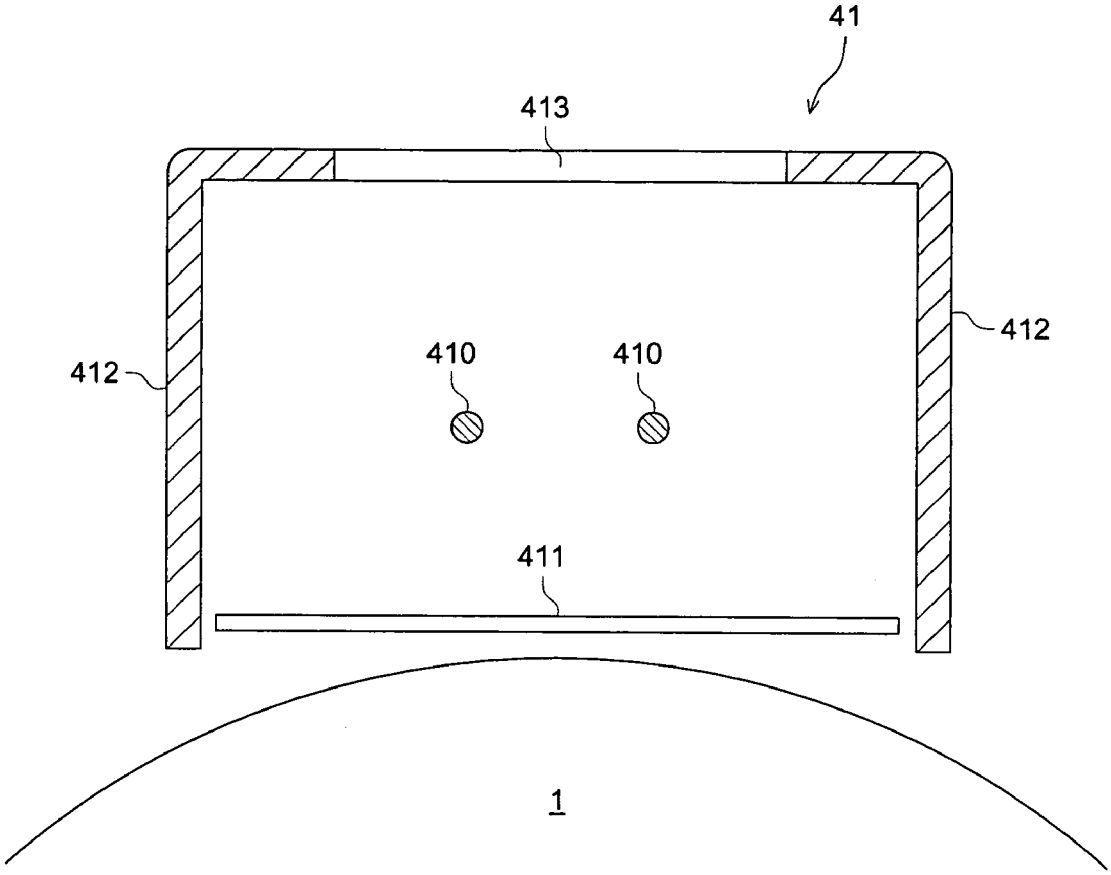
FIG. 2 is a sectional view showing the electrostatic charger of the image forming apparatus.

FIG. 2 is a cross sectional view of electrostatic charger 41 which comprises two tungsten wires 410 extending parallel with the surface of photoreceptor 1, rear plate 412 having opening 413 provided so as to surround discharging wires 410 and a scorotron electrostatic charger comprising grid 411 provided between photoreceptor 1 and discharging wires 410. Rear plate 412 also functions as a shielded electrode while a space of about 10 mm between discharging wires 410 and rear plate 412 is provided for operator safety.

Exposing apparatus 42 in image forming unit 40 modulates a semiconductor laser based on digitalized image information and conducts main scanning via a collimator lens, a polygon mirror and a lens group. Rotating photoreceptor 1 sub-scans whereby a reproduced electrostatic image is formed on the photoreceptor.

Prior to exposure, electrostatic charges with a predetermined voltage are transferred onto the surface of photoreceptor 1. Electrostatic charges in exposed areas decrease corresponding to the amount of exposure and result in an electrostatic latent image on photoreceptor 1 based on image information. The electrostatic latent image becomes a visualized toner image by developing toner supplied from developing apparatus 43.

Feeder 50 is provided in the lower portion of the main body of image forming apparatus 100. Plate 52 capable of being moved upward by a moving device is provided on the bottom of feeding cassette 61 used for storing recording paper sheet P. When receiving a feeding start signal, plate 52 on which recording medium, such as a paper sheet P is loaded lifts a paper sheet P until the top sheet is detected by an upper limit-detecting sensor. At the same time, pickup roller 53 moves downward to meet the top recording paper sheet P for feeding by pickup roller 53.

Top paper sheet P touching pickup roller 53 is fed from feeding cassette 51 and transferred to registration roller 57 guided by plural middle roller 56 after being separated into individual sheet by feeding roller 54 and separating roller 55. Recording medium, such as a paper sheet P is transferred to transfer/separation apparatus 44 after which the inclination of paper sheet P is corrected and the timing of feeding is adjusted by registration roller 57. Then the toner image formed on the surface of photoreceptor 1 is transferred onto paper sheet P in transfer/separation apparatus 44. After transferring, cleaning apparatus 45 removes residual toner left on photoreceptor 1.

Recording paper sheet P on which a toner image has been transferred is conveyed to fixing apparatus 60 and is processed for fixing after passing through substantially vertical conveyance path A. Recording paper sheet having been heated to fix an image thereon is cooled by a cooling fan (not shown) and stacked on recording paper sheet ejection platform 72 by ejecting roller 71. In image forming section 40, recording paper sheet P one side of which has been processed for image fixing is guided into re-conveyance bath 80 by ejecting path switching plate 73 and placed onto recording paper sheet ejection platform 72 by ejecting roller 71 in the ejecting section after being re-processed for dual sided image processing.

Figure 3:
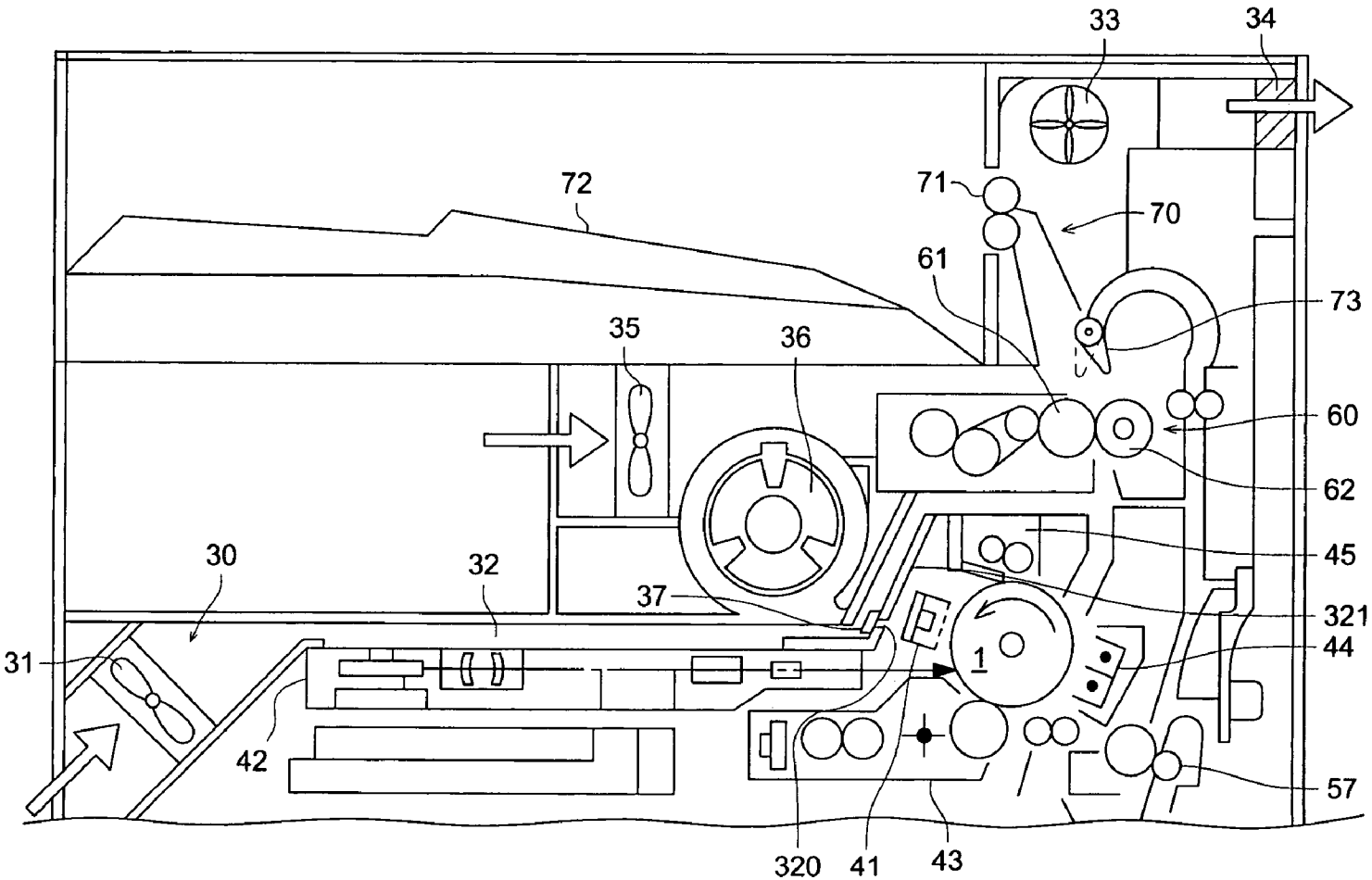
FIG. 3 is a block diagram showing the area adjacent to the cooling device of the image forming apparatus.

Fixing apparatus 60 comprises heating roller 61 and pressure roller 62 whereby recording paper sheet P is heated to a maximum of about 200° C. by heating roller 61. Consequently, since the interior temperature of image forming apparatus 100 rises, cooling device 30 is provided therein to cool fixing apparatus 60 and adjacent areas. FIG. 3 is a pattern diagram showing cooling device 30 and the adjacent areas. Fixing apparatus 60 also contains fixing dedicated fan 35 for equalizing the temperature distribution of heating roller 61.

Cooling device 30 comprises fan 31 for feeding cooling air from the outside of image forming apparatus 100 and duct 32 mounted to fan 31. Duct 32 for feeding cooling air is provided so as to pass above exposing apparatus 42 and between toner bottle 36 and the rear of electrostatic charger 41 to a point between fixing apparatus 60 and cleaning apparatus 45. Duct 32 is open so that air current can be blown into fixing apparatus 60.

Provided is exhaust fan 33 for removing air heated by the heat radiation of fixing apparatus 60 and also for removing air containing ozone generated by electrostatic charger 41 in the upper section of image forming apparatus 100. Also provided is ozone filter 34 for absorbing ozone contained the air to be exhausted. Ozone filter 34 removes ozone from air taken in by exhaust fan 33 after which the air is forcefully exhausted outside the image forming apparatus 100.

Figure 4:
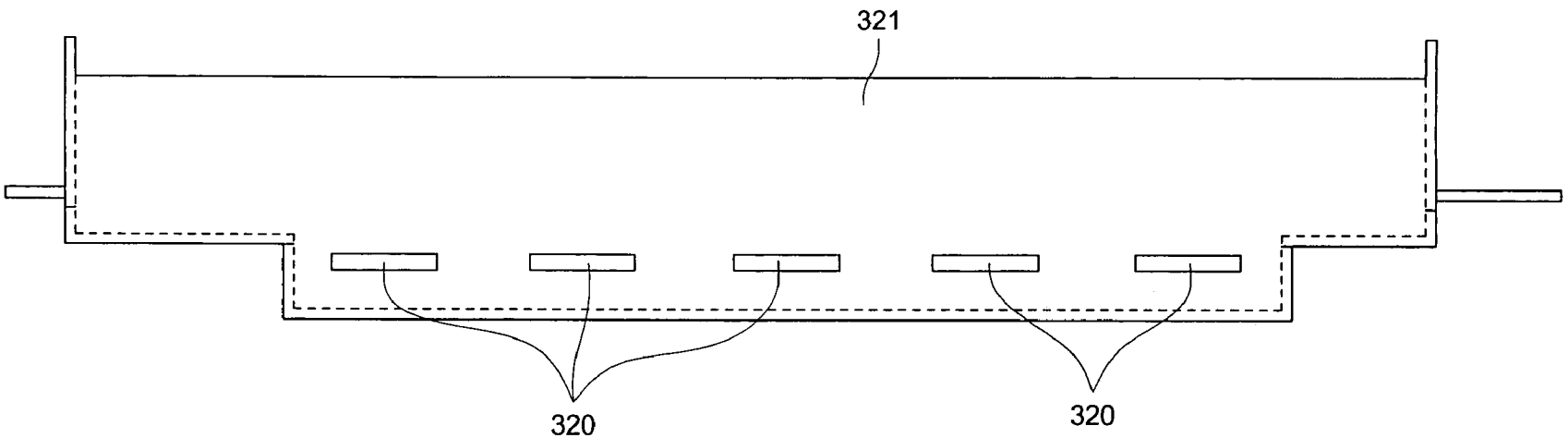
FIG. 4 is a plan view showing the opening formed in the duct wall for guiding airflow.

In image forming apparatus of the present invention, provided is side-wall 321 of duct 32 having an air current opening 320 facing rear plate 412 of electrostatic charger 41 (refer to FIG. 2) for air current. Duct 32 is arranged so that it angles up between toner bottle 36 and the rear of electrostatic charger 41. FIG. 4 is a plan view showing a possible shape of air current opening 320.

As shown in FIG. 4, sidewall 321 of duct 32 is formed as a flat plate shape and placed parallel to rear plate 412 of electrostatic apparatus 41. Air current opening 320 provided on duct 32 is formed as a slit shape along rear plate 412. On the other hand, as shown in FIG. 2, opening 413 formed in rear plate 412 formed as a shielding electrode of electrostatic generator 41 is provided at a position corresponding to the position of air current opening 320 formed on duct 32. An air current path to discharging wire 410 in electrostatic charge 41 is formed so that the air current passes through air current opening 320 formed in duct 32 and opening 412 formed on rear plate 413.

Figure 5:
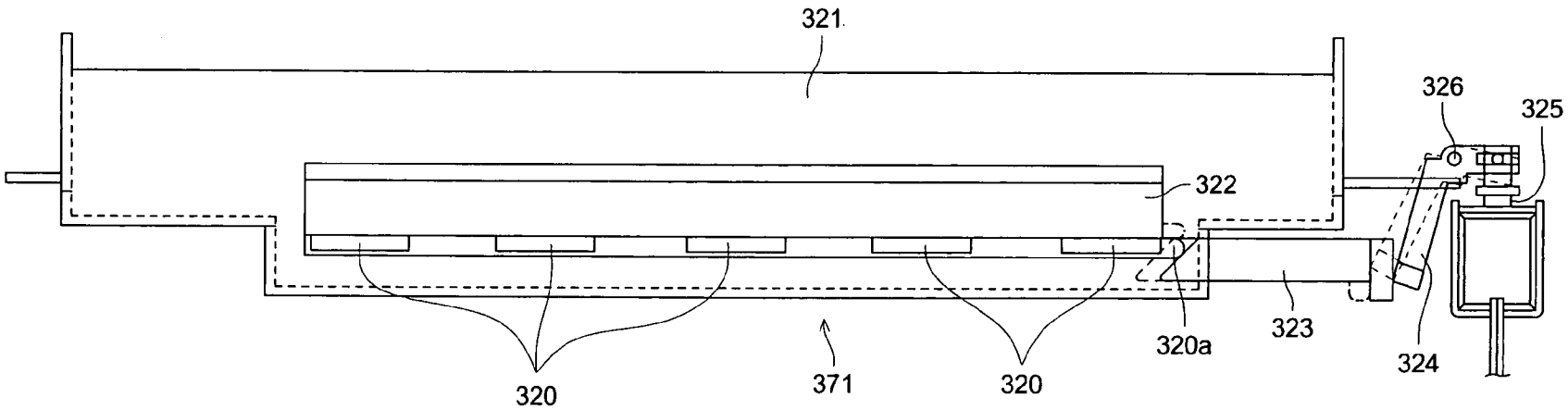
FIG. 5 is a block diagram showing a sliding shutter apparatus.
Figure 6:
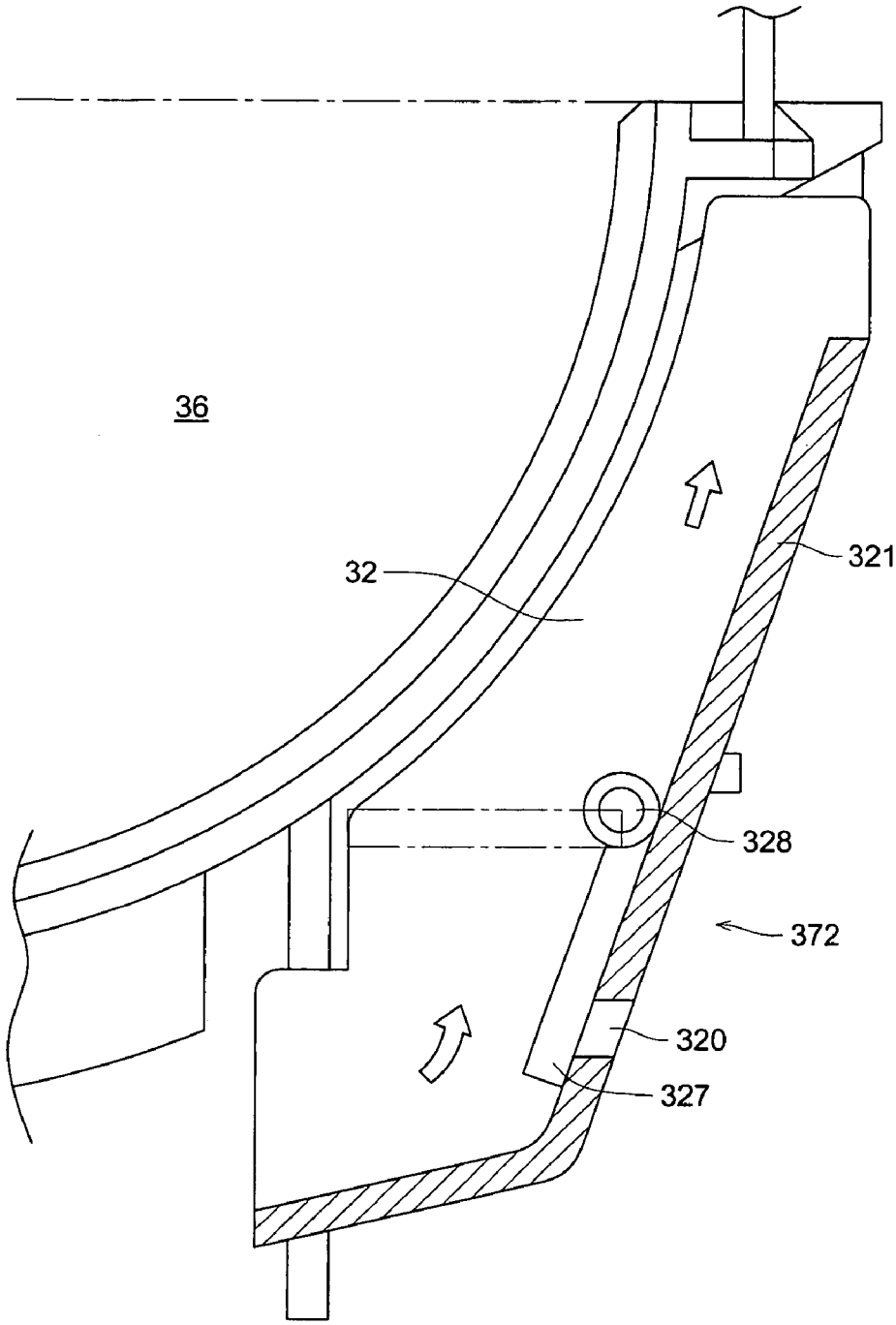
FIG. 6 is a block diagram showing a rotary shutter apparatus.

The preferable embodiment of image forming apparatus 100 is that shutter apparatus 37 is structured on air current opening 320 formed in duct 32. Shutter apparatus 37 opens/closes air current opening 32 formed on duct 32 and thereby controls an air current. Shutter apparatus 37 can be structured in a sliding system and a rotating system. FIG. 5 shows an embodiment of sliding shutter apparatus 371 while FIG. 6 shows an embodiment of rotary shutter apparatus 372.

As shown in FIG. 5, sliding shutter apparatus 371 comprises shutter plate 322 for opening and closing air current opening 320 provided in wall 321 of duct 32, middle member 323 for sliding up/down shutter plate 322, arm 324 for horizontally moving middle member 323 and forced power member 325 such as a plunger, etc. for giving arm 324 rotating forced power based on a control signal generated by controller 80 which will be described later.

Arm 324 is rotatably supported on fulcrum 326, one end of which is connected to forced power member 325. When forced power member 325 is driven, one end moves up or down and that movement is converted to rotation motion centering on fulcrum 326. The other end of arm 324 contacts middle member 323 and middle member 323 can be horizontally moved based on the rotation of arm 324.

A sliding surface is formed on the opposite end of the contacting surface of middle member 323 contacting to arm 324. A projection having a circular edge is provided on the lower edge of shutter plate 322 capable of vertical motion whereby projection **320*a* is in contact with the sliding surface of middle member 323. Normally, as projection 320*a* is positioned at the lower edge of the sliding surface, air current opening 320 is closed by shutter plate 322**.

The operation of sliding shutter apparatus 371 will be described below. When forced power member 325 is driven based on a control signal, arm 324 is rotated clockwise as shown by a dashed line in FIG. 5 and middle member 323 is shifted toward the left. As middle member 323 shifts, the sliding surface also shifts to the left. As projection **320*a* of shutter plate 322 slides upward along the sliding surface, shutter plate 322 is lifted upward. Whereby, air current opening 320** is opened.

When the drive of forced power member 325 stops, arm 324 looses rotation force and comes into a condition for being freely moved. As a result, gravity forces shutter plate 322 down and shifts middle member 323 in the right as shown in FIG. 5. Whereby the shutter plate is moved to the bottom, shutter plate 322 closes air current opening 320.

Rotary shutter apparatus 372 shown in FIG. 6 is provided in the air current path of duct 32 of cooling device 30. Rotary shutter apparatus 372 comprises shutter plate 327 and a forced device provides shutter plate 327 with a rotary force.

Shutter plate is arranged so that shutter plate 327 is normally positioned so that it is in contact with wall surface 321 of duct 32 for closing air current opening 320 (shown by a ridged line in FIG. 6). The rotary motion carried out between the position described above and position where the drive of the forced member closes the air current path of duct 32 is shown in dotted lines in FIG. 6. Shutter plate 327 is structured so that it may rotate on rotary support axis 328.

Figure 7:
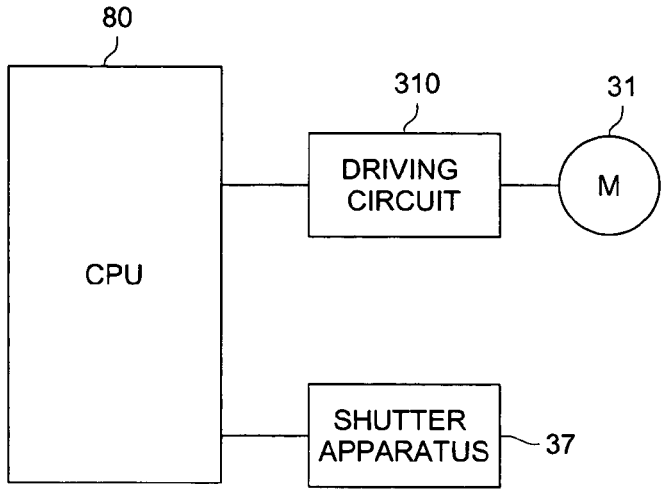
FIG. 7 is a block diagram showing a functional relationship of CPU in a control circuit, a motor for driving a fan for flowing an air current and a shutter member.
Figure 8:
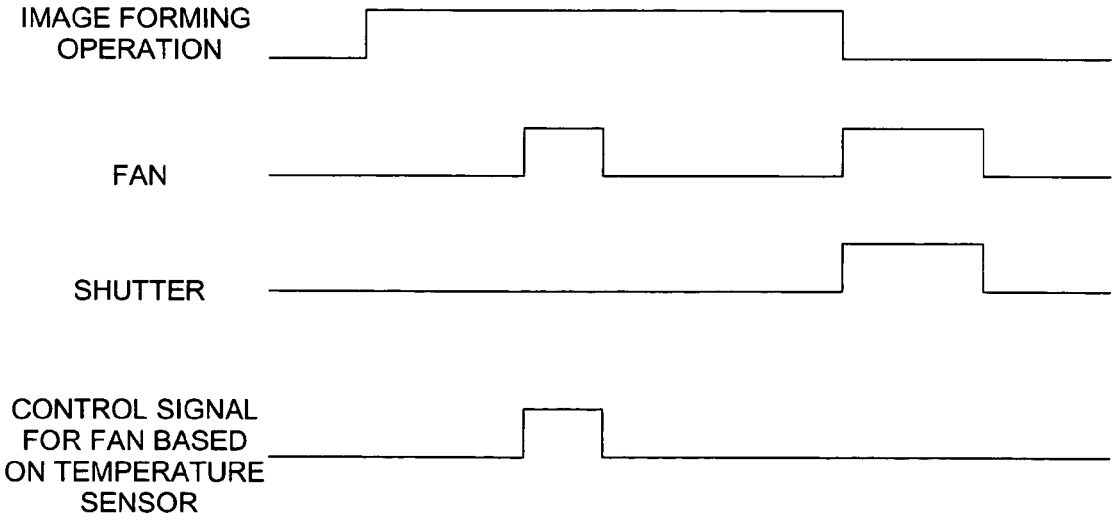
FIG. 8 is a time chart showing operations of the air fan and the shutter member associated with an image forming operation.

Image forming apparatus 100 incorporates controller 80 which controls the time period of air flow into electrostatic charger 41. The functional relationship of controller 80, fan 31 and shutter apparatus 37 is shown in FIG. 7. The controller 80 normally sends a signal to rotate fan 31 for a predetermined time period or generates a signal for opening air current opening 320 by driving shutter apparatus 37 in image forming apparatus 100 having shutter apparatus 37. When airflow to electrostatic charger 41 is needed, the controller drives the forced member of rotary shutter apparatus 372 to shift shutter plate 327 to the position where the air current path of duct 32 is closed. When the air flow is no longer necessary, rotary shutter apparatus 372 returns to the original position closing air current opening 320 and at the same time opening the air current path of duct 32. The time chart showing the relationship of the image forming operation by controller 80, the driving operation of fan 31 and the operation of shutter apparatus 37 is shown in FIG. 8.

The operation of image forming apparatus 100 of this invention will be described blow. The operation of airflow to electrostatic charger 41 will now be described since the operation of image forming apparatus 100 has already been described. When an image forming signal is inputted, photoreceptor 1 rotates and at the same time heating roller 61 of fixing apparatus 60 is energized. Then a high voltage is applied to discharging wires 410 of electrostatic charger 41 and corona discharge to photoreceptor 1 takes place. As a result, photoreceptor 1 is normally electrified with positive electrostatic charges.

Photoreceptor 1 is exposed by exposure apparatus 42 and is developed by adhered toner in developing apparatus 43. The toner image transferred onto a recording paper sheet P by transfer apparatus 44 which is conveyed to fixing apparatus 60. Heating roller 61 of fixing apparatus 60 is heated to a predetermined temperature whereby the temperature inside of image forming apparatus 100 also rises. Fan 31 serves to provide an air current into the area adjacent to fixing apparatus 60 and thereby cooling the interior of image forming apparatus 100.

Ozone generated by the energizing of discharging wires 410 drifts into the half-space formed by rear plate 412 of electrostatic charger 41 which prevents uniform charging of photoreceptor 1 for the subsequent charging operations by being attracted to discharging wires 410 and/or floating into the space adjacent to photoreceptor 1. In order to eliminate occurrence of an uneven charging and image failure (blurred images), controller 80 issues an air flow command signal to flow an air current to electrostatic charger 41 for a predetermined time period after completing an image forming operation.

The command signal activates shutter apparatus 37 and opens air current opening 320 of duct 32. If fan 31 is not being driven, the command signal also activates fan 31 to send a cooling air current flowing in duct 32 to electrostatic charger 41 via air current opening 320 and opening 413 formed on rear plate 412. If rotary shutter apparatus 372 is provided in the air current path in duct 32, a more efficient air current to electrostatic charger 41 is realized since by guiding an air current to electrostatic charger 41, shutter apparatus 37 simultaneously closes the air current path in duct 32. As a result, ozone is agitated and some of the ozone is exhausted from between electrostatic charger 41 and photoreceptor 1 to the exterior of electrostatic charger 41.

When the controller 80 releases the command signal to send an air current, air current opening 320 formed in duct 32 is closed and all cooling air is guided to the space adjacent to fixing apparatus 60, whereby the temperature rise caused by heating roller 61 in image forming apparatus 100 is controlled. Heated air is drawn into the upper portion of image forming apparatus 100 and exhausted outside the apparatus by exhausting fan 33. At the same time, ozone drifting into the space adjacent to electrostatic charger 41 is drawn and collected into upper portion of image forming apparatus 100. However the exhausting of ozone to the outside is prevented since ozone filter 34 absorbs ozone before exhausting outside of the apparatus.

As described above, based on the present invention since it becomes possible not only to lower the temperature inside image forming apparatus 100 but also to agitate ozone drifting in electrostatic charger 41 by utilizing fan 31 and duct 30 which configures cooling device 30, whereby uneven charging of electrostatic charger 41 is prevented by a simple configuration when electrifying photoreceptor 1.

According to the image forming apparatus of the present invention, it is not necessary to provide a dedicated duct for guiding an air current into an electrostatic charger since the wall of the duct for a cooling device in the image forming apparatus, which has an opening and the rear plate of an electrostatic charger having an opening are provided so that an air current flowing in the duct is guided via the openings, which is not only effective when designing a compact image forming apparatus, but also for cost reduction.

Further, since the fan can be rotated over a predetermined time to blow air into the electrostatic charger, the air does not foul each member in the image forming apparatus and does not affect the cooling function of a fixing device and adjacent areas with bad influences. Consequently, it is possible to avoid influence caused by ozone to the image forming apparatus. Further, if a shutter member is provided in an opening for blowing air provided in the wall of a duct, image quality can be easily assured, since the shutter member is closed to stop airflow to the electrostatic charger while cooling the interior of the image forming apparatus.

The image forming apparatus of the present invention is proposed from the viewpoint of preventing mottling of images and flowing an air current into an electrostatic charger is essential. However, since discharging wires 410 are also employed in transfer apparatus 44 in image forming apparatus 100, it is apparent that the present invention can be applied to any situation where the exhausting and agitation of ozone is desirable.

What is claimed is:

1. An image forming apparatus, comprising:

a main body;

an image forming section installed in the main body and having a photoreceptor to form an image and a corona discharger for conducting corona discharge onto the photoreceptor;

a fan for introducing air into the main body;

a duct communicating with the fan and having an opening to guide air into the corona discharger; and a controller for activating the fan so as to send air to the corona discharger for a predetermined time period after completion of an image forming operation.

2. The image forming apparatus of claim 1 further comprising:

a shutter provided in the opening of the duct; wherein the controller controls the shutter so as to open the opening of the duct so that the air is sent to the corona discharger.

3. An image forming apparatus, comprising:

a main body;

an image forming section installed in the main body and having a photoreceptor to form a toner image, a corona discharger for conducting corona discharge onto the photoreceptor and a fixing device to fix a toner image on a recording medium;

a fan for supplying air to cool the fixing device;

a duct communicating with the fan and having an opening through which air supplied from the fan is sent to the corona discharger; and a controller for activating the fan so as to send air to the corona discharger for a predetermined time period after completion of an image forming operation.

4. The image forming apparatus of claim 3 further comprising:

a shutter provided in the opening of the duct; wherein the controller controls the shutter so as to open the opening of the duct so that the air is sent to the corona discharger.

5. An image forming apparatus, comprising:

a main body;

an image forming section installed in the main body and having a photoreceptor to form a toner image, a corona discharger for conducting corona discharge onto the photoreceptor and a fixing device to fix a toner image on a recording medium;

an air supplying section having a fan and a duct, for supplying air to cool the fixing device, wherein the duct has an opening through which air supplied from the fan is sent to the corona discharger; and a controller for activating the fan so as to send air to the corona discharger for a predetermined time period after completion of an image forming operation.

* * * * *